United States Patent [19]

LaRock

[11] 4,206,334

[45] Jun. 3, 1980

[54] ROTATABLE ELECTRICAL CONTACT COMPONENT WITH DETENT

[75] Inventor: Donald W. LaRock, Crystal Lake, Ill.

[73] Assignee: Illinois Tool Works Inc., Chicago, Ill.

[21] Appl. No.: 944,527

[22] Filed: Sep. 21, 1978

[51] Int. Cl.[2] ..... H01H 9/00; G05G 5/06; H01H 21/76; H01H 85/04

[52] U.S. Cl. ..... 200/291; 200/11 G; 200/292; 200/302; 200/303; 338/163; 338/164; 338/184; 338/199

[58] Field of Search ..... 200/11 R, 11 A, 11 D, 200/11 DA, 11 E, 11 EA, 11 G, 11 J, 11 K, 11 TW, 16 D, 294, 295, 302, 303; 74/527, 531; 338/163, 164, 162, 184, 199, 197

[56] References Cited

U.S. PATENT DOCUMENTS

| | | | |
|---|---|---|---|
| Re. 23,750 | 12/1953 | Arisman et al. | 338/131 |
| 2,451,241 | 10/1948 | Rosentreter | 338/65 |
| 2,834,842 | 5/1958 | LeBeau | 74/527 |
| 3,089,923 | 5/1963 | Wright | 200/5 |
| 3,260,805 | 7/1966 | Pihl | 74/527 X |
| 3,294,929 | 12/1966 | Johnson | 200/11 J |
| 3,371,167 | 2/1968 | Soulakis, Jr. | 200/11 G |
| 3,437,766 | 4/1969 | Ahrens | 200/11 J X |
| 3,500,282 | 3/1970 | Slagg | 338/197 |
| 3,512,113 | 5/1970 | Kirkendall | 200/303 X |
| 3,518,389 | 6/1970 | Doering, Jr. et al. | 200/11 DA |
| 3,940,198 | 2/1976 | Andersen et al. | 339/5 M |
| 3,975,601 | 8/1976 | Whelan | 200/11 R |
| 3,983,352 | 9/1976 | Ellis, Jr. et al. | 200/11 J X |
| 4,034,178 | 7/1977 | Koppenheffer et al. | 200/291 X |
| 4,081,782 | 3/1978 | Hildreth et al. | 338/200 |
| 4,082,925 | 4/1978 | Hufford | 200/11 K X |
| 4,150,263 | 4/1979 | Neveux | 200/303 X |

FOREIGN PATENT DOCUMENTS

| | | | |
|---|---|---|---|
| 2356500 | 5/1975 | Fed. Rep. of Germany | 200/303 |

*Primary Examiner*—James R. Scott

*Attorney, Agent, or Firm*—Glenn W. Bowen; Robert W. Beart

[57] ABSTRACT

A three piece rotatable electrical contact component for printed circuit board applications, wherein a rotatable contact of the component engages electrical circuitry on a printed circuit board, is disclosed. The component consists of a generally circular contact element, a contact carrying rotor which is mounted to be rotatable in the printed circuit board, and to which said circular contact element is secured, and a ring-shaped stop member which snaps over the contact carrying rotor and is secured to the printed circuit board so as to be non-rotatable. The rotor, in addition, has a number of arcuate detent grooves formed around its periphery to provide a plurality of detent locations. The stop member has a flexible post that is located in a hole in the printed circuit board which is shaped so that rotational movement of the stop member is prevented, but so that the stop member is free to transversely flex and thereby cooperate with the detent grooves of the rotor to provide the desired detent action.

2 Claims, 2 Drawing Figures

ROTATABLE ELECTRICAL CONTACT COMPONENT WITH DETENT

BACKGROUND OF THE INVENTION

Miniature rotatable electrical contact components for printed circuit board applications are widely used in electrical and electronic equipment. One type of suitable contact structure for such components is shown in U.S. Pat. No. 3,940,198, issued in the name of Andersen et al, on Feb. 24, 1976 and assigned to the assignee of the present invention. These electrical components also consist of a rotor which has a bushing that is formed with a shoulder so that when the bushing protrudes through an aperture in the printed circuit board the shoulder engages the bottom of the board to hold the rotatable member in place. The contact structure is riveted to the rotor so that it may engage the electrical circuitry formed on the upper surface of the printed circuit board. In many applications it is desirable to provide a stop so that only limited rotation of the rotor is allowed. The stop member may be provided by a post that extends down into an aperture in the printed circuit board which prevents rotation of the stop member.

It is also desirable in many applications to include detent provisions so that the rotation of the rotor may be accurately controlled from one step to the next. Detents are conventionally provided by means of a spring which is fixed to a stationary support. The rotor is generally provided with a plurality of grooves which receive the end of the spring in succession as the rotor is rotated, thereby allowing the rotor to be moved from one position to the next. The use of a separate spring, however, presents undesirable complications. This is because the spring must either be separately attached to the printed circuit board thereby taking up valuable printed circuit area, and necessitating modification of the printed circuit board in many cases, in order to secure the spring to the board. Another way of securing the spring to a station and support would be to secure it to a stationary part of the housing of the component itself. However, this complicates the housing construction and can appreciably increase the size and cost of the component. The snap-on stop ring of the present invention functions both to stop the rotor at a predetermined position and provides detent action due to its unique construction and to the configuration of a retaining aperture in the printed circuit board, whereby rotational movement of the stop member is prevented by the rectangular shape of the aperture but transverse flexing motion of the stop member is allowed to provide the detent function. The present invention thereby achieves an extremely simple, small and cost effective structure.

DESCRIPTION OF THE DRAWINGS

The present invention is described by reference to the drawings in which.

TECHNICAL DESCRIPTION OF THE INVENTION

Figure 1:
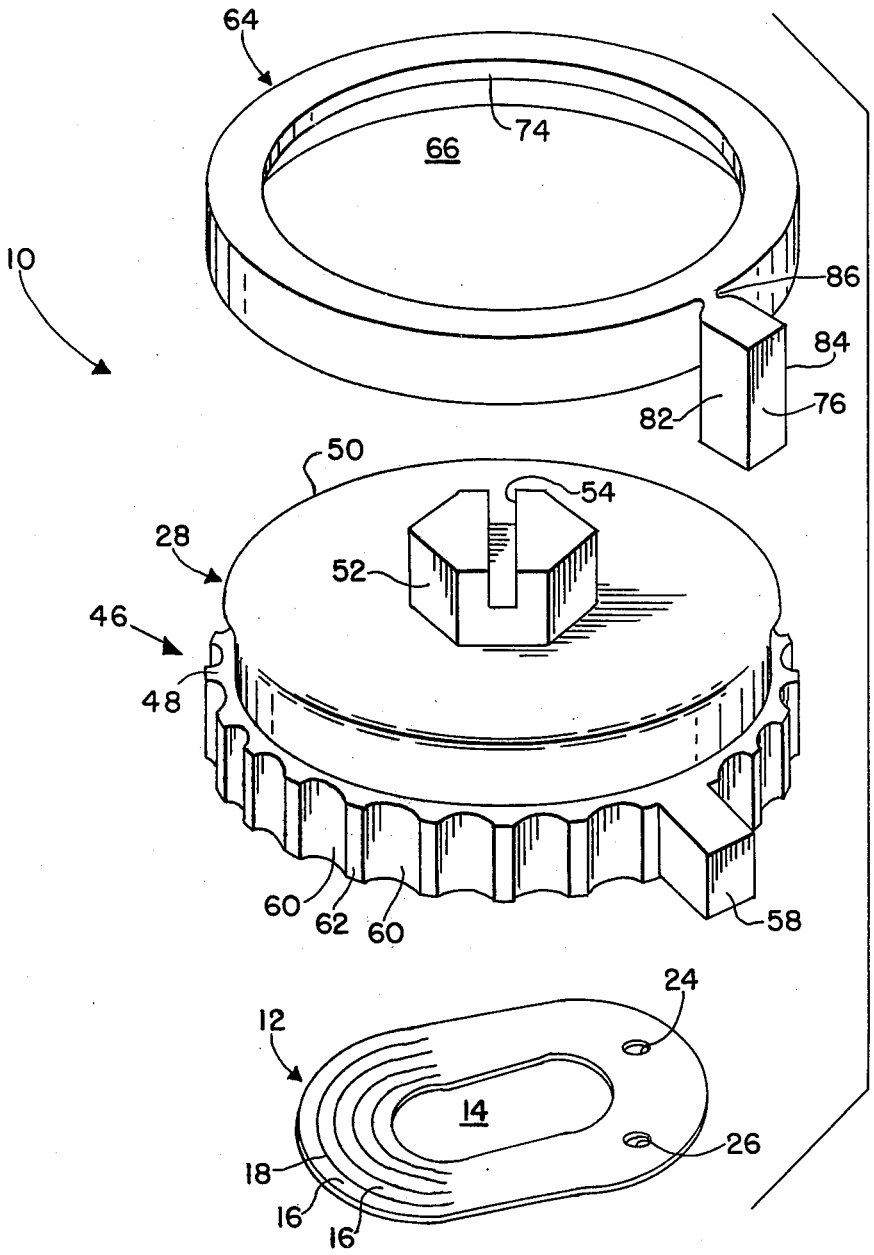
FIG. 1 is an exploded view of the present invention.

An exploded view of the rotatable contact component 10 of the present invention is shown in FIG. 1. The electrical contact 12 is preferably of the type shown in U.S. Pat. No. 3,940,198, issued Feb. 24, 1976 to Andersen et al and assigned to the assignee of the present invention. This contact has a central aperture 14 and a plurality of flexible arcuate contact members 16 which are separated by slits 18 so as to allow the contact structure to make multiple connections with the associated circuit configuration 20 on the printed circuit board 22. A pair of rivet holes 24, 26 are provided to allow the contact 12 to be secured to the rotor 28 by means of rivets 30. The rotor 28 is formed with a downwardly projecting bushing 32 that has a slot 34 in it so that it may be compressed together and inserted through the aperture 36 in the printed circuit board 22. When inserted into this aperture, the shoulder 38 will be locked against the lower surface 40 of the printed circuit board.

Figure 2:
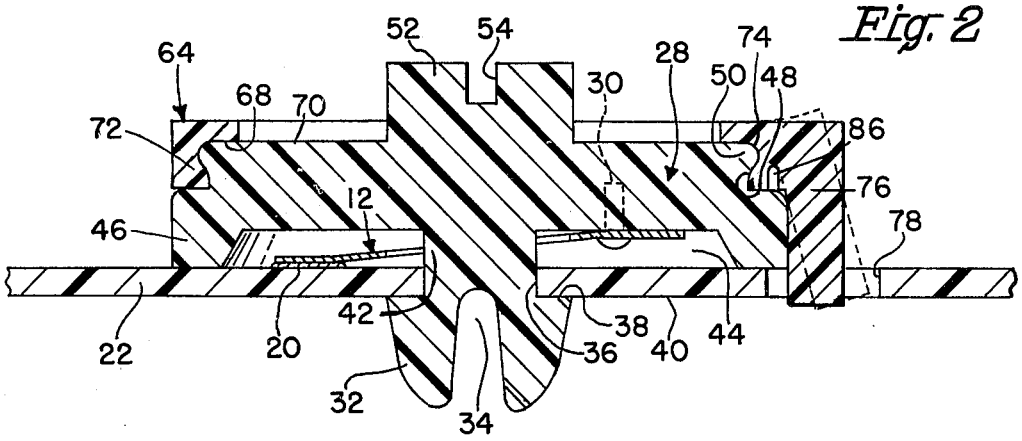
FIG. 2 is a cross-sectional view of the present invention taken along the lines 2—2 of FIG. 1.

The contact 12 is located so that its aperture 14 receives the reduced diameter shaft portion 42 of the rotor 28 therein as shown in FIG. 2. The cavity 44 which encloses the contact 12 is substantially protected from the environment by means of the circular flange 46 which extends around the outer periphery of the lower portion of the rotor 28. The flange 46 has an inwardly projecting shoulder 48 above which there is an outwardly projecting rib 50. A reduced diameter, hexagonally shaped knob, or nut, 52 which is used to rotate the rotor projects upwardly from the rotor. For an alternate way of turning the rotor, the knob may have a screwdriver slot 54 in it, if desired. Also projecting outwardly from the outer periphery of the rotor 28 is a rectangular shaped stopping block 58. Around the remaining portion of the outer periphery of the rotor 28, there are a plurality of arcuate-shaped grooves 60 which are separated from each other by means of flange sections 62.

The third member of the rotatable contact component 10 is the generally annular snap ring 64. The ring 64 has a central aperture 66 which is large enough so that the ring may be snapped in place on the rotor 28 as shown in FIG. 2, with the lower surface 68 of the ring 64 in contact with the upper surface 70 of the rotor 28. The ring 64 has an inwardly projecting shoulder 72 which conforms to the shoulder 48 of the rotor 28. A groove 74 is provided on the inner surface of the ring 64 which receives the rib 50 of the rotor 28 to provide a guide surface for the rotor as it rotates relative to the stationary ring 64. The ring 64 has a generally rectangular shaped block 76 that projects downwardly from its outer periphery into an aperture 78 in the printed circuit board 22. The lower end of the block 76 projects through the aperture 78 which is shaped so that the sides of the hole are rectangular with the sides of the aperture being in close proximity to the surface areas 82, 84 of the rectangular block 76 thereby preventing rotation of the stop member when the rotor 28 is rotated. However, the aperture 78 is elongated so that it allows the rectangular stop block 76 to flex in a radial direction relative to the rotor 28.

Flexibility of the stop block 76 is improved by a reduced area section 86 where the block 76 joins the periphery of the ring 64. Thus, as the rotor 28 is rotated, the component may be moved from one detent location to the next due to the flexing action of the block 76 as it progresses from one detent groove 60 to the next due over the intermediate flange 62 between the grooves. The flexing action of the block 76 is represented by the dotted lines in FIG. 2 which shows the block 76 when it is contacting the flange 62, but the solid lines in FIG.

2 shows the block 76 when it is in a groove 60. At the extreme rotation of the rotor 28, the block 58 will engage the block 76 and the rotor will thus be stopped at a predetermined desired location.

What is claimed is:

1. In a rotatable electrical component comprising an electrical contact for making contact with electrical circuitry on a substrate, a generally circular-shaped rotor secured to said electrical contact and mounted on said substrate so as to allow for the rotation of said rotor relative to said substrate, said rotor having a plurality of detent grooves and a plurality of flanges on its outer periphery which separate said detent grooves, and a detent member secured to said substrate in a manner such that said detent member interacts with said detent grooves and flanges but does not rotate with the rotation of said rotor, the improvement wherein said detent member is an annular-shaped ring and said ring and said rotor have complementary shoulder and groove means which allow said detent member to fit on and guide said rotor as it rotates, and said ring is constructed with a flexible elongated detent projection thereon which runs substantially parallel to said grooves and the end of which is inserted into an aperture in said substrate which is dimensioned so that it restrains said detent projection from rotation while allowing said detent projection to flex radially with respect to said rotor, so that said rotor may rotate from one detent position to the next due to the flexing of said detent projection as a result of engagement of said detent projection with said flanges and the subsequent relaxing of said detent projection into said grooves when said rotor is rotated.

2. In a rotatable electrical component as claimed in claim 1, the further improvement wherein an elongated stop projection is provided on the periphery of said rotor which projects substantially normal to said detent projection on said stop member and which engages said detent projection of said detent member upon a predetermined rotation of said rotor.

* * * * *